US006830235B2

(12) United States Patent
Stafford

(10) Patent No.: US 6,830,235 B2
(45) Date of Patent: Dec. 14, 2004

(54) HYDRAULIC POWERED CAPSTAN ATTACHMENT

(76) Inventor: Clark P. Stafford, 132 Pyramid Dr., Rock Springs, WY (US) 82901

( * ) Notice: Subject to any disclaimer, the term of this patent is extended or adjusted under 35 U.S.C. 154(b) by 0 days.

(21) Appl. No.: 10/372,552

(22) Filed: Feb. 20, 2003

(65) Prior Publication Data

US 2003/0155563 A1 Aug. 21, 2003

Related U.S. Application Data

(60) Provisional application No. 60/358,839, filed on Feb. 21, 2002.

(51) Int. Cl.[7] ..... B66D 3/04

(52) U.S. Cl. ..... 254/389; 254/332; 254/361; 254/380

(58) Field of Search ..... 254/266, 323, 254/329, 332, 362, 380, 389, 390, 409, 360, 361, 328

(56) References Cited

U.S. PATENT DOCUMENTS 4,234,167 A * 11/1980 Lane ..... 254/291
4,312,497 A * 1/1982 Whaley ..... 254/344
5,029,816 A * 7/1991 Langston ..... 254/134.3 FT
5,240,298 A * 8/1993 Teaby et al. ..... 294/81.4
5,683,073 A * 11/1997 Pickrell ..... 254/134.3 FT
6,073,917 A * 6/2000 Plummer ..... 254/389
6,152,424 A * 11/2000 Lapat ..... 254/98
6,267,356 B1 * 7/2001 Crawford ..... 254/266
6,494,437 B1 * 12/2002 Boyer ..... 254/323
6,578,823 B1 * 6/2003 Johnson ..... 254/334
6,672,568 B1 * 1/2004 Rawlinson ..... 254/323

FOREIGN PATENT DOCUMENTS

JP 402068291 * 3/1990 ..... 254/329

* cited by examiner

*Primary Examiner*—Emmanuel Marcelo
(74) *Attorney, Agent, or Firm*—Irving M. Weiner; Pamela S. Burt; Weiner & Burt, P.C.

(57) ABSTRACT

A hydraulic capstan to pull electric or communication wire through conduit or open trenches over long distances from a stationary position. The capstan is powered by a hydraulic motor. An operator can activate the motor from inside the cab of a vehicle to turn the capstan. The rope attached to the wire is wrapped around the capstan. When the rope is pulled tight on the turning capstan, the rope comes on one side and off the other side, pulling the wire load.

20 Claims, 1 Drawing Sheet

FIG. 1
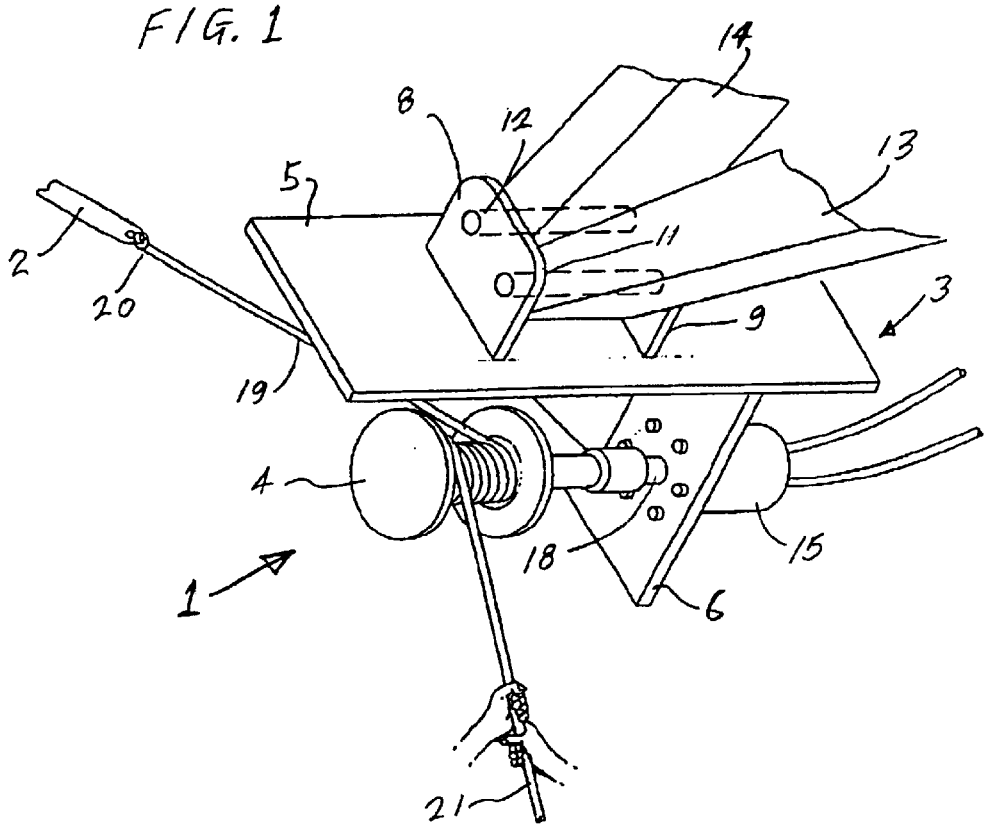
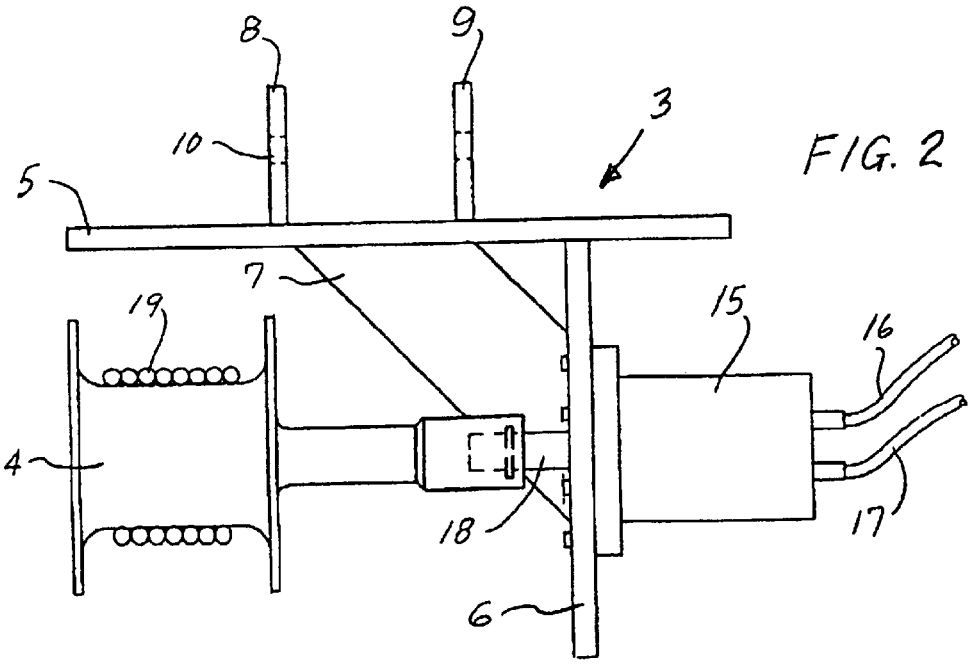
FIG. 2

HYDRAULIC POWERED CAPSTAN ATTACHMENT

The present patent application is based on and claims priority from U.S. Provisional Patent Application Ser. No. 60/358,839 filed Feb. 21, 2002.

The present invention relates generally to certain new and useful improvements in hydraulic powered capstan attachments.

More particularly, the present invention relates to an apparatus for pulling electric or communication wire or any other desired load through conduit or open trenches over long distances from a stationary position.

BACKGROUND OF THE INVENTION

Heretofore, various attempts have been made to pull cable or wire through conduit or open trenches over long distances, but such attempts have been relatively unsuccessful. The relevant art is exemplified by the following United States patents:

- U.S. Pat. No. 4,169,580 issued in 1979 to Hatlapa et al. entitled "HYDRAULIC WINCH FOR SHIPBOARD USE";
- U.S. Pat. No. 4,234,167 issued in 1980 to Lane entitled "AUTOMATIC INHAUL WINCH SYSTEM";
- U.S. Pat. No. 4,458,880 issued in 1984 to Conti entitled "METHOD AND APPARATUS TO MEASURE TENSION IN A PULL LINE FOR CABLE";
- U.S. Pat. No. 4,852,856 issued in 1989 to Correll entitled "SYSTEM FOR LAYING COMMUNICATIONS CABLE ESPECIALLY ADAPTED FOR AERIALLY STRINGING FIBER OPTIC CABLE AND ADAPTED FOR INTERCHANGEABLE USE WITH CONVENTIONAL CABLE";
- U.S. Pat. No. 5,029,816 issued in 1991 to Langston entitled "LOW FRICTION PULLING OF FIBER OPTIC CABLE IN CONDUIT";
- U.S. Pat. No. 5,324,006 issued in 1994 to Pickrell entitled "APPARATUS FOR PULLING CABLE";
- U.S. Pat. No. 5,503,370 issued in 1996 to Newman et al. entitled "METHOD AND APPARATUS FOR THE INJECTION OF CABLE INTO COILED TUBING";
- U.S. Pat. No. 5,516,080 issued in 1996 to McVaugh entitled "CABLE PLACING APPARATUS";
- U.S. Pat. No. 5,533,711 issued in 1996 to Pickrell entitled "APPARATUS AND METHOD FOR PULLING CABLE";
- U.S. Pat. No. 5,599,004 issued in 1997 to Newman et al. entitled "APPARATUS FOR THE INJECTION OF CABLE INTO COILED TUBING";
- U.S. Pat. No. 5,664,765 issued in 1997 to Pickrell entitled "APPARATUS AND METHOD FOR PULLING CABLE";
- U.S. Pat. No. 5,683,073 issued in 1997 to Pickrell entitled "APPARATUS AND METHOD FOR PULLING CABLE";
- U.S. Pat. No. 6,086,050 issued in 2000 to Wiederkehr et al. entitled "APPARATUS FOR PULLING A TRACTION CABLE THROUGH AN UNDERGROUND PIPE"; and
- U.S. Pat. No. 6,109,082 issued in 2000 to Taylor et al. entitled "AUTOMATIC SET-UP WIRE DRAWER".

SUMMARY OF THE INVENTION

The present invention provides a hydraulic powered capstan attachment for pulling a load over long distances from a stationary position, comprising, in combination: a vehicle having a boom and a source of hydraulic power; a hydraulic motor selectively connectible to said source of hydraulic power and having an output shaft; a mounting frame having a first portion thereof which is rotatably connectible to said boom, and having a second portion thereof to which said hydraulic motor may be mounted and through which said output shaft may extend; a capstan removably connectible to said output shaft; and a rope wound around said capstan and having a first end thereof removably connectible to said load and having a second end thereof controlled by a worker so that when the worker pulls said rope tight on said capstan, the capstan begins pulling said load.

A primary object of the invention is to provide a novel hydraulic capstan arrangement for pulling electric or communication wire, or any other desired load, through conduit or open trenches over long distances from a stationary position.

Another object of the present invention is to provide a hydraulic powered capstan attachment as described hereinabove wherein the frame may be attached to a backhoe in place of the conventional backhoe bucket.

A further object of the present invention is to provide a hydraulic powered capstan attachment as described hereinabove for mounting upon any suitable vehicle, such as, for example, a Bobcat 231 Excavator.

A further object of the present invention is to provide a hydraulic powered capstan attachment as described hereinabove wherein the capstan can be selectively removed from the output shaft and the hydraulic motor.

Yet another object of the present invention is to provide a hydraulic powered capstan attachment as described hereinabove, which includes a quick attach system which could be incorporated in the attachment to simplify changing attachments on the excavator or other associated vehicle.

A further object of the present invention is to provide the hydraulic powered capstan invention as described hereinabove, which may include a bucket angle or swivel attachment.

Another object of the present invention is to provide a hydraulic powered capstan attachment as described hereinabove, wherein the attachment is designed and built to aide in pulling primary and secondary power cable through conduit or through a ditch.

The present invention possesses many other advantages and features which will become more apparent to those persons skilled in this particular area of technology or others when reading the detailed description of one exemplary preferred embodiment of the present invention as set forth hereinbelow in conjunction with the accompanying drawings.

BRIEF DESCRIPTION OF THE DRAWINGS

FIG. 1 is a perspective illustration of a preferred embodiment of the present invention, and depicting the novel apparatus in use.

FIG. 2 is a front elevational view of the FIG. 1 embodiment with the backhoe bucket linkage and backhoe arm removed for ease of understanding.

DETAILED DESCRIPTION OF SOME PREFERRED EMBODIMENTS

In accordance with the preferred embodiment of the present invention, there is provided, as illustrated in FIGS. 1 and 2, a novel hydraulic powered capstan attachment apparatus 1 for pulling a load, such as an electrical cable 2, over long distances from a stationary position.

The apparatus 1 includes a mounting frame 3 for the hydraulically driven capstan to facilitate mounting on a suitable vehicle (not shown), for example, a 231 Bobcat Excavator.

The mounting frame 3 may comprise: a baseplate 5 which is preferably, but not necessarily, one inch thick steel, 14 inches wide and 26 inches long; a hydraulic motor mount plate 6, which may preferably, but not necessarily be fabricated from one inch thick steel; a pair of steel braces 7 positioned on each side of the baseplate (only one such brace 7 is shown in the drawings for clarity purposes), and wherein each said brace 7 is preferably, but not necessarily, fabricated from ¾ inch thick steel which is six inches wide; two steel plates 8 and 9 with pinholes 10, wherein such steel plates 8 and 9 are fabricated, preferably but not necessarily, from ¾ inch thick steel; and pinholes 11 and 12 for the 231 Bobcat Excavator dipper stick 13 and bucket linkage 14, respectively, wherein such pinholes 11 and 12 are, preferably but not necessarily, 1 and 5/16 inches in diameter.

The mounting frame 3 and its components 5, 6, 7, 8 and 9 which are mentioned hereinabove are welded together into a unitary unit of great strength.

The steel plates 8 and 9 are used for rotatably connecting the mounting frame 3 to the boom of a vehicle. In particular, the plates 8 and 9 are used for connecting a backhoe bucket linkage 14 and a backhoe arm 13 as shown in FIG. 1. This enables the capstan mounting frame 3 to be rotated.

A hydraulic motor 15 is provided with hydraulic hoses 16 and 17, which are hydraulically connected to the host machine. The hydraulic motor 15 is bolted to the hydraulic motor mount plate 6 of the mounting frame 3.

The output shaft 18 of the hydraulic motor 15 extends through the mounting plate 6 for removable and selective connection to the capstan 4. The capstan 4 is mounted to rotate clockwise, as viewed in FIG. 1, with the output shaft 18 of the hydraulic motor 15.

A rope 19 is wound around the capstan 4. A first end of the rope is connected to the cable 2, or other load to be pulled.

The second end 21 of the rope 19 is held by a worker. When the worker pulls the rope 19 downwardly, the rope 19 tightens down on the capstan 4 and the capstan 4 begins pulling the load 2.

There has been illustrated in the accompanying drawing only one unique and novel embodiment of the present invention which can be constructed in many different configurations, arrangements of components, sizes and shapes.

It should be understood that many changes, modifications, variations and other uses and applications will become apparent to those persons skilled in this particular area of technology and others after having been exposed to the present patent specification and accompanying drawings.

Any and all such changes, modifications, variations, and other uses and applications which do not depart from the spirit and scope of the present invention are therefore covered by and embraced within the present invention and the present patent application.

What is claimed is:

1. A hydraulic powered capstan attachment for pulling a load over long distances from a stationary position, comprising, in combination:

a vehicle having a boom and a source of hydraulic power;

a hydraulic motor selectively connectible to said source of hydraulic power and having an output shaft;

a mounting frame having a first portion thereof which is rotatably connectible to said boom, and having a second portion thereof to which said hydraulic motor is mounted and through which said output shaft extends;

a capstan removably connectible to said output shaft; and a rope wound around said capstan and having a first end thereof removably connectible to said load and having a second end thereof controlled by a worker so that when the worker pulls said rope tight on said capstan, the capstan begins pulling said load.

2. The hydraulic powered capstan attachment according to claim 1, wherein:

said mounting frame is shaped, designed and dimensioned so that said mounting frame is attached to a backhoe in place of a conventional backhoe bucket.

3. The hydraulic powered capstan attachment according to claim 2, wherein:

said mounting frame includes a base plate, a hydraulic motor mount plate depending from said baseplate, and a pair of brace members positioned on each side of said baseplate.

4. The hydraulic powered capstan attachment according to claim 3, wherein:

said mounting frame includes a pair of plate members provided with a first pair of pinholes to accommodate a Bobcat Excavator dipper stick, and a second pair of pinholes to accommodate a bucket linkage.

5. The hydraulic powered capstan attachment according to claim 2, wherein:

said mounting frame includes a pair of plate members provided with a first pair of pinholes to accommodate a Bobcat Excavator dipper stick, and a second pair of pinholes to accommodate a bucket linkage.

6. The hydraulic powered capstan attachment according to claim 1, wherein:

said mounting frame includes a baseplate, a hydraulic motor mount plate depending from said baseplate, and a pair of brace members positioned on each side of said baseplate.

7. The hydraulic powered capstan attachment according to claim 6, wherein:

said mounting frame includes a pair of plate members provided with a first pair of pinholes to accommodate a Bobcat Excavator dipper stick, and a second pair of pinholes to accommodate a bucket linkage.

8. The hydraulic powered capstan attachment according to claim 1, wherein:

said mounting frame includes a pair of plate members provided with a first pair of pinholes to accommodate a Bobcat Excavator dipper stick, and a second pair of pinholes to accommodate a bucket linkage.

9. A hydraulic powered capstan attachment for pulling electric or communication wire, or any other desired load, through a conduit or open trenches over long distances from a stationery position, comprising, in combination:

first means having a boom and a source of hydraulic power;

a hydraulic motor selectively connectible to said source of hydraulic power and having an output shaft;

a mounting frame having a first portion thereof which may be selectively and pivotably connectible to said boom, and having a second portion thereof to which said hydraulic motor is mounted and through which said output shaft extends;

a capstan removably connectible to said output shaft; and second means wound around said capstan and having a first end thereof removably connectible to said load, and having a second end thereof controllable so that when said second means is pulled tight on said capstan, said capstan begins pulling said load.

10. The hydraulic powered capstan attachment according to claim 9, wherein:

said first means comprises a vehicle.

11. The hydraulic powered capstan attachment according to claim 10, wherein: said second means comprises a rope.

12. The hydraulic powered capstan attachment according to claim 11, wherein:

said mounting frame includes a baseplate, a hydraulic motor mount plate depending from said baseplate, and a pair of brace members positioned on each side of said baseplate.

13. The hydraulic powered capstan attachment according to claim 10, wherein:

said mounting frame includes a baseplate, a hydraulic motor mount plate depending from said baseplate, and a pair of brace members positioned on each side of said baseplate.

14. The hydraulic powered capstan attachment according to claim 9, wherein:

said second means comprises a rope.

15. The hydraulic powered capstan attachment according to claim 14, wherein:

said mounting frame includes a baseplate, a hydraulic motor mount plate depending from said baseplate, and a pair of brace members positioned on each side of said baseplate.

16. The hydraulic powered capstan attachment according to claim 9, wherein:

said mounting frame is shaped, designed and dimensioned so that said mounting frame is attached to a backhoe in place of a conventional backhoe bucket.

17. The hydraulic powered capstan attachment according to claim 16, wherein:

said mounting frame includes a baseplate, a hydraulic motor mount plate depending from said baseplate, and a pair of brace members positioned on each side of said baseplate.

18. The hydraulic powered capstan attachment according to claim 17, wherein:

said mounting frame includes a pair of plate members provided with a pair of pinholes to accommodate a Bobcat Excavator dipper stick, and a second pair of pinholes to accommodate a bucket linkage.

19. The hydraulic powered capstan attachment according to claim 9, wherein:

said mounting frame includes a baseplate, a hydraulic motor mount plate depending from said baseplate, and a pair of brace members positioned on each side of said baseplate.

20. The hydraulic powered capstan attachment according to claim 9, wherein:

said mounting frame includes a pair of plate members provided with a pair of pinholes to accommodate a Bobcat Excavator dipper stick, and a second pair of pinholes to accommodate a bucket linkage.

* * * * *